US006305993B1

(12) United States Patent
Heimueller

(10) Patent No.: US 6,305,993 B1
(45) Date of Patent: Oct. 23, 2001

(54) CONTACT SOCKET

(75) Inventor: Hans Jost Heimueller, Dudenhofen (DE)

(73) Assignee: Tyco Electronics Amp GmbH (DE)

( * ) Notice: Subject to any disclaimer, the term of this patent is extended or adjusted under 35 U.S.C. 154(b) by 0 days.

(21) Appl. No.: 09/773,199

(22) Filed: Jan. 31, 2001

(30) Foreign Application Priority Data

Jan. 31, 2000 (EP) ..... 00101873

(51) Int. Cl.[7] ..... H01R 11/22
(52) U.S. Cl. ..... 439/852
(58) Field of Search ..... 439/850–853, 439/842–845

(56) References Cited

U.S. PATENT DOCUMENTS 5,645,458 * 7/1997 Hotea ..... 439/852
5,707,259 * 1/1998 Ishizuka et al. ..... 439/852
5,839,925 * 11/1998 Simmons ..... 439/852
5,941,741 * 9/1999 Dobbelaere et al. ..... 439/852
6,095,873 * 8/2000 Muramatsu et al. ..... 439/852
6,227,915 * 5/2001 Sakatani et al. ..... 439/852

* cited by examiner

*Primary Examiner*—Brian Sircus
*Assistant Examiner*—Son V. Nguyen

(57) ABSTRACT

The contact socket is of single-part construction and has a base spring and two spring legs, which are integrally formed on the base spring and both spring legs include contacting sections, facing each other where, as a result of the single-piece construction, the manufacturing process of this contact socket can be optimized and one of the spring legs is supported by an additional support member thereby increasing the resilient force.

12 Claims, 2 Drawing Sheets

2
1
13
5
14
8
12
13
14
12
7
11
7
3

12
3

12
3

12
3

12
3

CONTACT SOCKET

BACKGROUND OF THE INVENTION

The present invention relates to a contact socket for receiving a tab or pin terminal.

DESCRIPTION OF THE PRIOR ART

A contact socket according to the preamble of claim 1 is disclosed in DE 196 19 514 A1. The known contact sockets have a complicated construction and are therefore difficult to manufacture. These known contact sockets are expensive to manufacture. It is therefore an object of the present invention to provide a contact socket allowing the design of a simpler manufacturing process and which thereby entails lower costs.

SUMMARY OF THE INVENTION

This object is achieved by a contact socket having two internal spring legs formed on a base spring, contacting sections of the spring legs face each other, and one of the two spring legs is bent in a U-shaped configuration, while the other spring leg is bent linearly, extending slightly obliquely towards the interior of the base spring, characterized in that the linear spring leg is supported by a support member bent in a U-shape configuration.

Accordingly, the contact socket, which is of a single-part construction, has a base spring (or a base part) and two internal spring legs, the contacting sections of which face each other. The single-part construction allows the optimization of the manufacturing process which consists essentially of a bending operation and/or stamping operation.

A further advantage of the contact socket according to the invention is that the resilient force on one of the two spring legs can be relatively easily increased by a support member which is also formed integrally on the base spring, and on the free end thereof one of the spring legs is supported. The resilient force can hereby be considerably increased.

BRIEF DESCRIPTION OF THE DRAWINGS

FIG. 3 shows a layout of the contact socket according to FIGS. 1 and 2; and FIG. 4 show a diagram for explaining part of the bending operation of a contact socket according to the invention.

DETAILED DESCRIPTION OF THE PREFERRED EMBODIMENT

Figure 2:
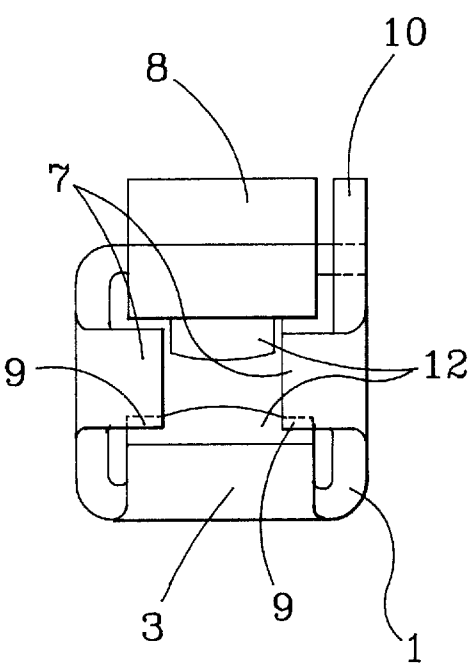
FIG. 2 shows a further cross-sectional view of the contact socket according to FIG. 1.
Figure 1:
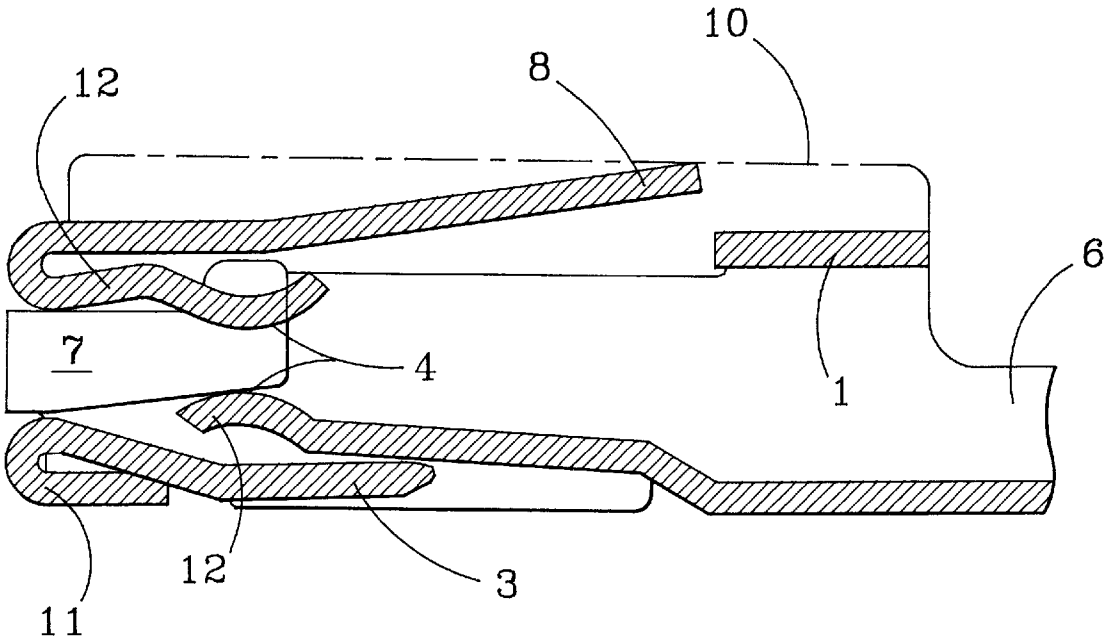
FIG. 1 shows a schematic cross-sectional view of a contact socket according to the invention, in accordance with a preferred embodiment of the present invention.

FIGS. 1 and 2 show a contact socket according to the invention in accordance with a preferred embodiment, where a lateral cross-sectional view of a base spring 1 is shown, on which two spring legs 12 are seen, which face each other with their contact sections 4 on the inside of the base spring 1. According to this first embodiment an external latching tongue 8 is formed on the base spring 1 (shown on top in FIGS. 1 and 2). The spring legs 12 lie inside base spring 1. According to the view of FIG. 1, a facing second (lower) spring leg 12 is foreseen on the base spring 1 opposite the first (upper) spring leg 12 such that the contact sections 4 of spring legs 12 face each other in the plug-in direction.

It can furthermore be clearly seen from FIG. 1 and 2 that spring legs 12 are completely accommodated inside the base spring 1. The latching tongue 8 protrudes upwards at an acute angle of approximately 5° beyond the base spring 1. The two spring legs 12 form a readily resilient contact metal piece by which current is directly, and therefore more efficiently, conducted.

FIG. 3 shows the layout of the base spring 1. This view is not to scale. The layout of the base spring 1 with integral spring legs 12 has a compact form resulting in reduced loss of sheet metal during stamping.

On the base spring 1 a projection 10 is additionally foreseen which is bent approximately at a right angle from base spring 1, as shown in FIG. 2, to form a polarisation of the contact socket. The contours of the layout of base springs 1 are preferably stamped out of flat metal sheets, or possibly cut by laser, as shown in FIG. 3. After the stamping operation, the individual base springs 1 are separated and each bent and/or pressed, until the state shown in FIGS. 1 and 2 is established. The base spring 1 can preferably be soldered by means of a laser, such that a solder pad is set on at least one location on the tool from the top in order to fix base spring 1. The base spring 1 (or base part) can also be fixed by pressing; the projections 13 shown in FIG. 3 come into engagement with apertures 14 and are then pressed such that in this manner the base spring 1 can be stabilised or fixed in its form.

The construction of the present contact socket according to the invention, in particular through the cooperation of both spring legs 12, allows creation of the relatively high resilient force whereby improved spring action of the spring components can be achieved. In the contact socket shown, in order to further increase the spring action, the one spring leg 12 is supported from one free end of a support member 3.

This support member 3 is formed as a further spring member by means of a free punch 5 and is connected to base 11 via a base spring 1. In order to further increase the resilient force of the lower spring leg 12 it is supported by support member 3. The upper spring leg 12 is formed on the top edge of the base spring 1 by backward folding.

Finally, several tabs 7 are formed on both sides of an insertion opening (of base spring 1) for a contact pin (not shown), which tabs show outwardly rounded contours and facilitate the insertion of the contact pin. As can be seen from FIG. 2, the tabs 7 also serve to prevent an insertion behind the lower spring leg 12, since the lower spring leg 12 in its two lateral end sections 9 is prevented by tabs 7 from moving upwards. The lower spring leg 12 cannot be further displaced upwardly than as shown in FIG. 1. In this position of the lower spring leg 12 the lateral end sections 9 lie adjacent to the lower edge of tabs 7. The tabs 7 thereby form a pre-aperture of spring legs 12.

In the embodiment of the contact socket according to the invention shown, the consumption of material is minimized since the loss of sheet metal during stamping is reduced. As is shown in the layout according to FIG. 3, there is little stamping residue.

Figures 1, 4A, 4B, 4C, 4D:
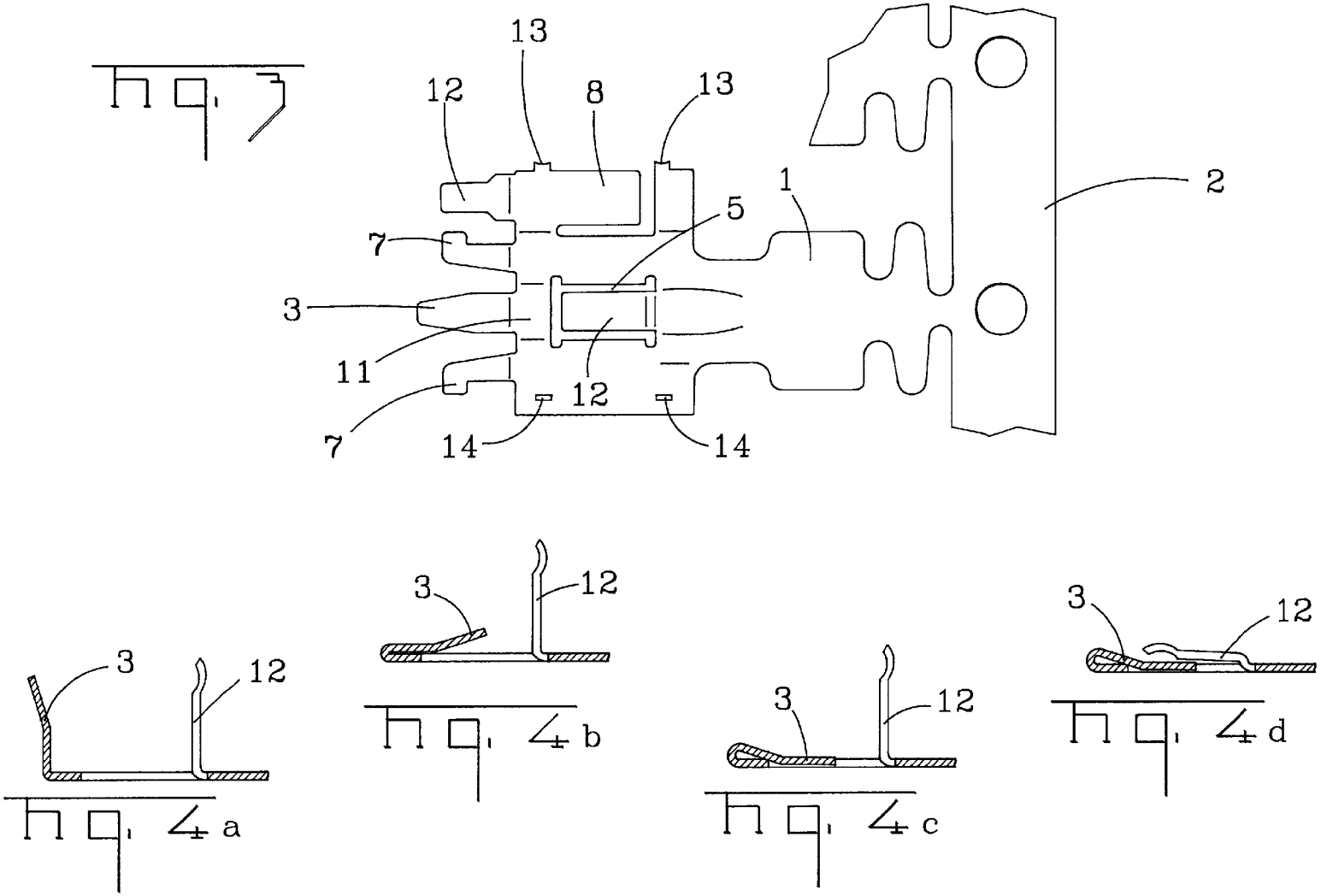

FIG. 4 shows part of a bending operation of the contact socket according to the invention. The lower spring leg 12 and the support member 3 are bent in five steps. For this purpose, the contact socket is first stamped out. In the first bending step the lower spring leg 12 is then bent upwards, approximately at a right angle from the base plane (extending horizontally in FIG. 4) in an upwardly protruding direction. The support member 3 is then bent upwards and bent backwards as shown in the bending step 2 (with respect to the plug-in direction in the contact socket), into the free punch 5 of the lower spring leg 12. The final position of support member 3 is shown in bending step 3. In the bending step 4 the lower spring leg 12 is further bent forwards until it comes to lie on support member 3. Finally, in a fifth bending step, the position of the lower spring leg 12 is calibrated.

In summary, the contact socket according to the invention, which is of a single-part construction, comprises a base spring 1 and two spring legs 12, which are integrally formed on base spring 1. Both spring legs 12 comprise contacting sections 4, essentially facing each other. As a result of the single-piece construction, the manufacturing process of this contact socket can be optimized. Furthermore, one of the spring legs 12 is supported by an additional support member 3 thereby increasing the resilient force.

For further characteristics and advantages of the present invention, specific reference is hereby made to the appended claims and drawings.

What is claimed is:

1. A contact socket having a single-piece construction, comprising two resilient internal spring legs formed on a base part, each spring leg having a contact section which contact sections are oriented to face each other, wherein a first one of the spring legs is bent in a U-shaped configuration, a second one of the spring legs is a substantially linear member bent to extend towards an interior portion of the base part, and wherein the second one of the spring legs is supported by a support member bent in a U-shape configuration.

2. The contact socket according to claim 1, further comprising a latching tongue that protrudes outside of the base part.

3. The contact socket according to claim 2, wherein a free end of the first spring leg extends in a direction opposite to a free end of the second spring leg.

4. The contact socket according to claim 3, wherein the base part is made of a copper alloy.

5. The contact socket according to claim 4, wherein a free end of the support member extends in the same direction as the free end of the first spring leg.

6. The contact socket according to claim 5, wherein the support member supports the second spring leg to limit deflection thereof.

7. The contact socket according to claim 6, wherein the base part comprises a box shaped member in which at least two adjacent walls are fixed in position by at least one laser soldering point.

8. The contact socket according to claim 7, wherein the base part is manufactured from a flat metal sheet through operations selected from stamping, bending, pressing and combinations thereof.

9. The contact socket according to claim 7, wherein the base part comprises a box shaped member in which at least two adjacent walls are fixed in position by pressing of at least one projection in an aperture.

10. The contact socket according to claim 9, further comprising a polarisation in the form of a projection extending from the base part.

11. The contact socket according to claim 10, further comprising at least one tab formed on the base part adjacent to the second spring leg, which the tab ensures a connection contact between a mating contact and the second spring leg.

12. The contact socket according to claim 11, wherein a tab is provided on each side of the second spring leg to define a pre-aperture.

* * * * *